US009237399B2

(12) United States Patent
Lagodzinski et al.

(10) Patent No.: US 9,237,399 B2
(45) Date of Patent: Jan. 12, 2016

(54) MASKING VEHICLE NOISE

(71) Applicant: GM Global Technology Operations LLC, Detroit, MI (US)

(72) Inventors: James T. Lagodzinski, Royal Oak, MI (US); Frank C. Valeri, Novi, MI (US); Scott M. Reilly, Davisburg, MI (US); John P. Miller, Howell, MI (US); Oliver Jung, Trebur (DE)

(73) Assignee: GM Global Technology Operations LLC, Detroit, MI (US)

( * ) Notice: Subject to any disclaimer, the term of this patent is extended or adjusted under 35 U.S.C. 154(b) by 203 days.

(21) Appl. No.: 13/963,034

(22) Filed: Aug. 9, 2013

(65) Prior Publication Data

US 2015/0043744 A1 Feb. 12, 2015

(51) Int. Cl.

| | |
|---|---|
| ***H04R 3/02*** | (2006.01) |
| ***H04R 3/00*** | (2006.01) |
| ***H04R 3/12*** | (2006.01) |
| *H04R 1/02* | (2006.01) |

(52) U.S. Cl.

CPC ..... *H04R 3/002* (2013.01); *H04R 3/12* (2013.01); *H04R 2499/13* (2013.01)

(58) Field of Classification Search

CPC ..... G10K 11/175; G10K 2210/1282; G10K 2210/128; H04R 3/04; H04R 2499/13; H04R 1/028

USPC ..... 381/71.1, 71.4, 71.14, 73.1, 94.1, 94.7, 381/101, 302, 389, 13; 704/226; 375/346, 375/254

See application file for complete search history.

(56) References Cited

U.S. PATENT DOCUMENTS

| | | | | |
|---|---|---|---|---|
| 2010/0239110 | A1* | 9/2010 | Lasch et al. | 381/307 |
| 2011/0026723 | A1* | 2/2011 | Inoue | 381/71.4 |
| 2012/0076315 | A1* | 3/2012 | Hetherington et al. | 381/71.4 |
| 2012/0078465 | A1 | 3/2012 | Reilly et al. | |
| 2012/0269358 | A1* | 10/2012 | Gee et al. | 381/71.4 |

* cited by examiner

*Primary Examiner* — Paul S Kim
*Assistant Examiner* — Norman Yu
(74) *Attorney, Agent, or Firm* — Cantor Colburn LLP

(57) ABSTRACT

A method of masking sounds associated with a vehicle is provided. The method includes performing on processing circuitry, monitoring of vehicle data. A tonal disturbance type and a tone to mask associated with the tonal disturbance type are identified based on the vehicle data. A shaped band of sounds is determined based on the tone to mask. The shaped band of sounds covers a range of frequencies around the tone to mask. The shaped band of sounds is applied to an audio output of the vehicle.

20 Claims, 5 Drawing Sheets

MASKING VEHICLE NOISE

FIELD OF THE INVENTION

Exemplary embodiments of the invention are related to systems and methods for masking vehicle noise using sound enhancement.

BACKGROUND

Electric and hybrid vehicles can exhibit different sound profiles while transitioning through various driving conditions. Sounds in electric or hybrid vehicles can be especially apparent due to the low amount or absence of background engine noise. During certain vehicle maneuvers, vehicle operators may have preexisting expectations of vehicle sounds that can differ from actual vehicle sounds. Transitions, such as an electric motor speed change during vehicle deceleration, can cause abrupt changes in sounds emitted from the vehicle. Unexpected abrupt changes in sound can be undesirable to the vehicle operator. Accordingly, it is desirable to provide systems and methods for improving the overall soundscape of a vehicle.

SUMMARY OF THE INVENTION

In one exemplary embodiment, a method of masking noise associated with a vehicle is provided. Processing circuitry monitors vehicle data. A tonal disturbance type and a tone to mask associated with the tonal disturbance type are identified based on the vehicle data. A shaped band of sounds is determined based on the tone to mask. The shaped band of sounds covers a range of frequencies around the tone to mask and may have lower energy content at the tone to mask. The shaped band of sounds is applied to an audio output of the vehicle.

In another exemplary embodiment, a system is provided that includes a disturbance determination module and a noise masking module. The disturbance determination module monitors vehicle data and identifies a tonal disturbance type and a tone to mask associated with the tonal disturbance type based on the vehicle data. The noise masking module determines a shaped band of sounds to apply as an audio output based on the tone to mask, the shaped band of sounds covering a range of frequencies around the tone to mask, and may have lower energy content at the tone to mask.

In a further exemplary embodiment, a vehicle is provided that includes a powertrain, a control module that selectively controls one or more components of the powertrain and generates vehicle data, and a vehicle noise masking system. The vehicle noise masking system monitors the vehicle data, identifies a tonal disturbance type and a tone to mask associated with the tonal disturbance type based on the vehicle data, determines a shaped band of sounds to apply as an audio output of the vehicle based on the tone to mask, the shaped band of sounds covering a range of frequencies around the tone to mask, and may have lower energy content at the tone to mask.

The above features and advantages and other features and advantages of the invention are readily apparent from the following detailed description of the invention when taken in connection with the accompanying drawings.

BRIEF DESCRIPTION OF THE DRAWINGS

Other objects, features, advantages and details appear, by way of example only, in the following detailed description of embodiments, the detailed description referring to the drawings in which.

DESCRIPTION OF THE EMBODIMENTS

Figure 1:
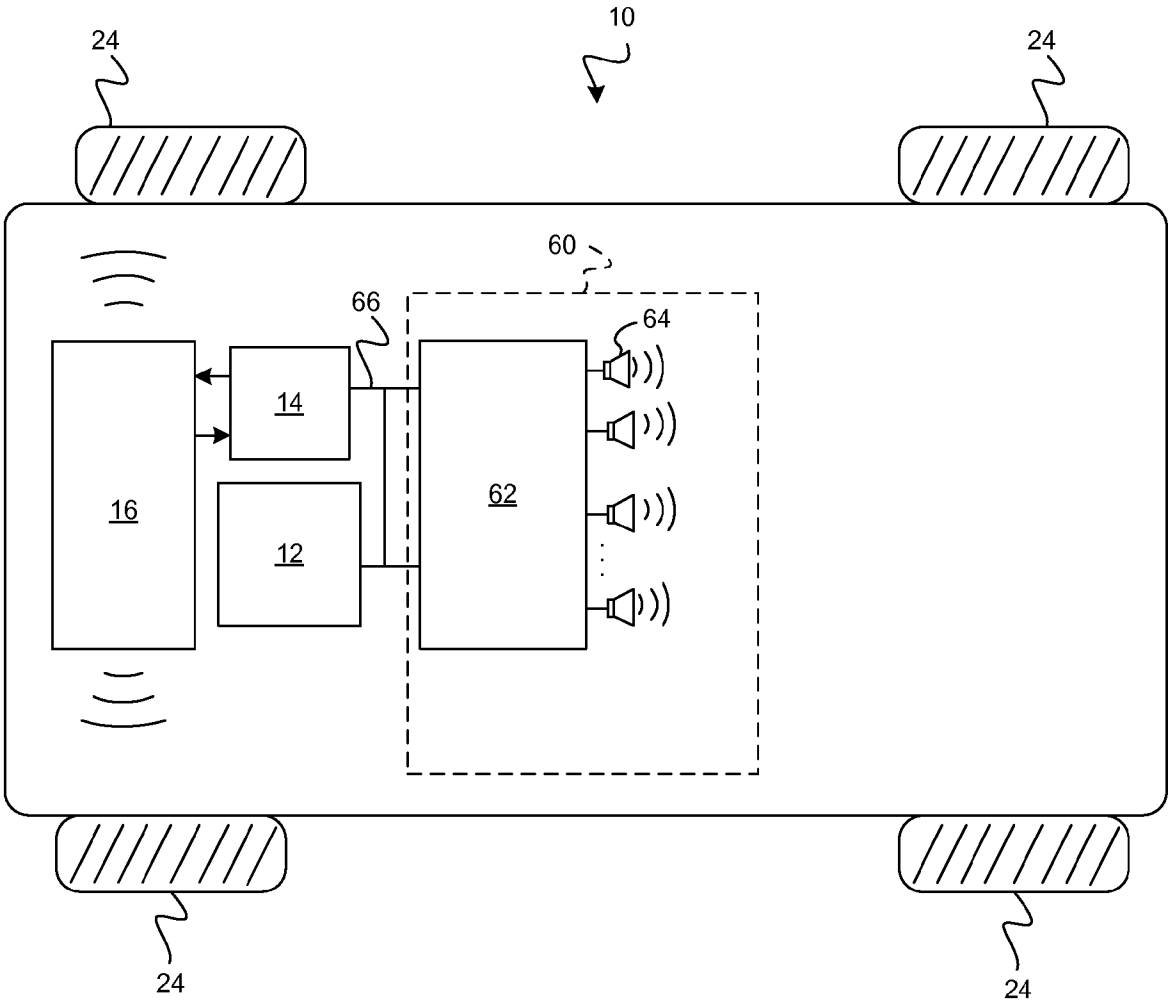
FIG. 1 is a schematic illustration of a vehicle including a vehicle noise masking system in accordance with an exemplary embodiment.

The following description is merely exemplary in nature and is not intended to limit the present disclosure, its application or uses. It should be understood that throughout the drawings, corresponding reference numerals indicate like or corresponding parts and features. As used herein, the term module refers to processing circuitry that may include an application specific integrated circuit (ASIC), an electronic circuit, a processor (shared, dedicated, or group) and memory that executes one or more software or firmware programs, a combinational logic circuit, and/or other suitable components that provide the described functionality.

In accordance with an exemplary embodiment of the invention a vehicle is shown generally at 10 in FIG. 1. The vehicle 10 includes a vehicle noise masking system 12. The vehicle noise masking system 12 communicates with one or more control modules 14. The one or more control modules 14 (hereinafter referred to as control module 14) control a powertrain 16 of the vehicle 10. The powertrain 16 includes one or more sources of propulsion for the vehicle 10.

Figure 2:
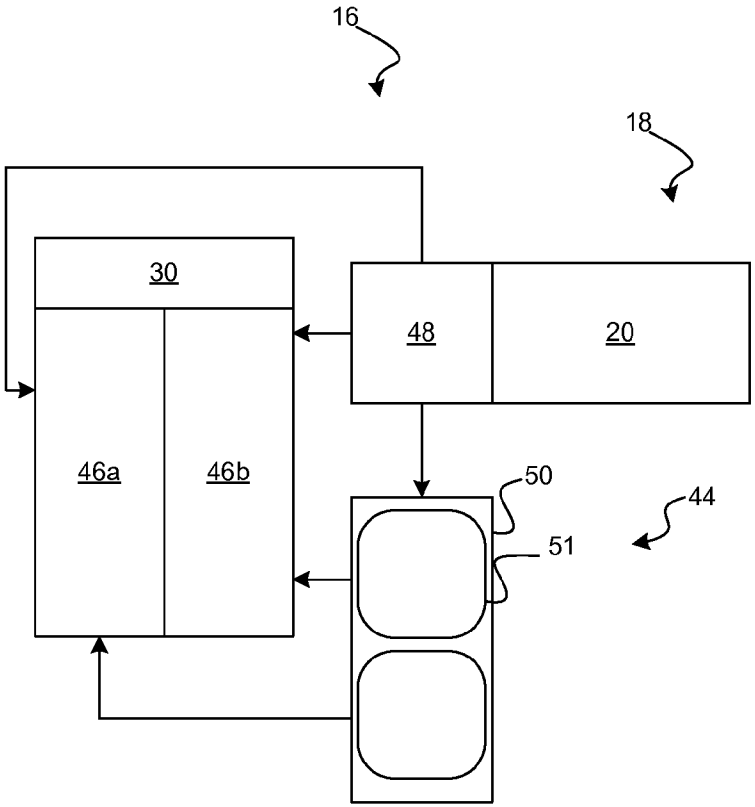
FIG. 2 is an illustration of a hybrid system powertrain configuration of the vehicle of FIG. 1 in accordance with an exemplary embodiment.

In various embodiments, as shown in FIG. 2, the powertrain 16 includes an engine system 18. The engine system 18 includes an internal combustion engine 20 that combusts an air and fuel mixture to produce drive torque. As can be appreciated, the vehicle noise masking system 12 is applicable to various engines 20 and is not limited to the present example.

In an embodiment, as shown in FIG. 2, the powertrain 16 includes a hybrid system 44 that includes an engine 20 and one or more electric drive motors 46. In the example of FIG. 2, the hybrid system 44 includes two electric drive motors 46*a* and 46*b* coupled to a transmission 30. The hybrid system 44 can be arranged in a series configuration (as shown), in a parallel configuration, or in a series-parallel configuration. When in the series configuration, the engine 20 drives a generator 48 to generate electricity. The electricity is stored in an energy storage system 50 (e.g., a plurality of batteries 51) or is sent to the electric drive motors 46*a* and 46*b*. The electric drive motors 46*a* and 46*b* can function as the primary sources of propulsion of the vehicle 10 by driving two or more wheels 24 of FIG. 1 via the transmission 30. The transmission 30 uses a gear set (not depicted) to transmit mechanical energy through a drive shaft (not depicted) and one or more axles (not depicted) to two or more of the wheels 24 of FIG. 1. The electric drive motors 46*a* and 46*b* operate based on energy from the energy storage system 50 and/or from the engine 20.

When in the parallel configuration (configuration not shown), the engine 20 and the electric drive motors 46*a* and 46*b* each function as a source of propulsion of the vehicle 10.

The engine 20 and the electric drive motors 46*a* and 46*b* can operate together to propel the vehicle 10 and/or individually based on torque demands.

Figure 3:
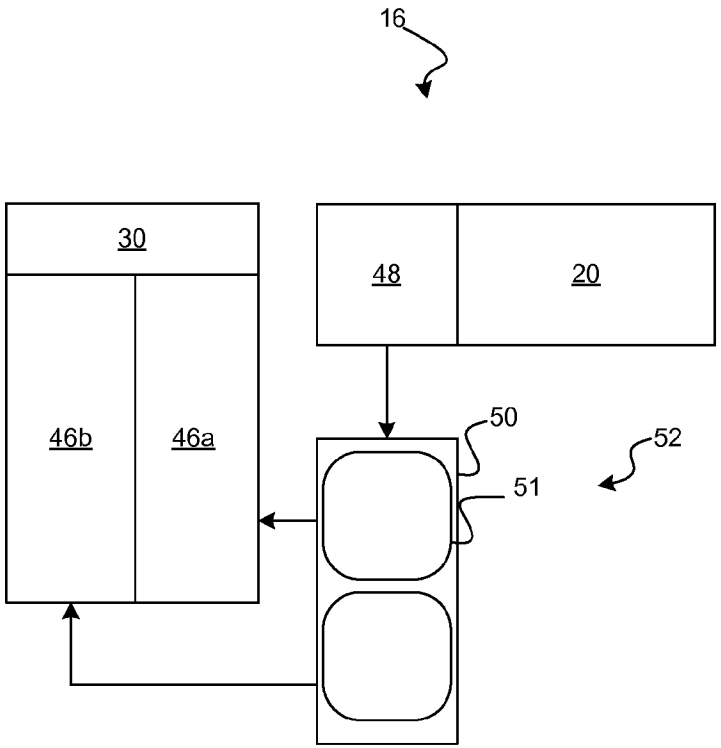
FIG. 3 is an illustration of an electric system powertrain configuration of the vehicle of FIG. 1 in accordance with an exemplary embodiment.

In various other embodiments, as shown in FIG. 3, the powertrain 16 is a pure electric system 52 that includes the one or more electric drive motors 46. In the example of FIG. 3, the pure electric system 52 includes two electric drive motors 46*a* and 46*b* coupled to transmission 30. The electric drive motors 46*a* and 46*b* operate on energy from the energy storage system 50. The energy storage system 50 can be charged via an exterior power source (e.g., by plugging into an electrical outlet). In such an arrangement, an engine 20 can be provided as an alternative charging source to charge the energy storage system 50 when the state of charge is low, thus, providing an extended range of use.

With reference back to FIG. 1, the vehicle noise masking system 12 further communicates with an infotainment system 60. Amongst other functions typical to vehicle infotainment systems, the infotainment system 60 includes an infotainment module 62 that manages the generation of various sounds within the vehicle 10 and/or outside of the vehicle 10 through one or more speakers 64. The speakers 64 can be located within the vehicle interior, under the vehicle hood, and/or on an exterior of the vehicle 10.

As can be appreciated, the vehicle noise masking system 12 can be integrated within the control module 14, can be integrated within the infotainment module 62, or can be separate from the control module 14 and the infotainment module 62 and can communicate with each via a vehicle communication network 66. The vehicle communication network 66 can include one or more communication buses including shared links, independent point-to-point links, wired links, optical links, and/or wireless links according to known communication protocols. For exemplary purposes, the disclosure will be discussed in the context of the vehicle noise masking system 12 being separate from and in communication with the infotainment module 62 and the control module 14.

In various embodiments, the vehicle noise masking system 12 monitors data that are generated by the control module 14 and that are communicated on the vehicle communication network 66. Based on the data, the vehicle noise masking system 12 identifies tonal disturbances and performs one or more sound management methods. The sound management methods communicate with the infotainment system 60 to perform vehicle noise masking of sounds generated by the vehicle 10. The sounds generated by the vehicle 10 can originate from one or more subsystems of the vehicle 10, such as the powertrain 16. In various embodiments, the sound management methods include sound blending methods. In various embodiments, the sound blending methods introduce a shaped band of sounds to mask sounds generated by the vehicle 10. Vehicle noise masking may be applied for tones that cannot be accommodated by active noise cancellation. For example, vehicle noise masking can be applicable for higher frequency hissing-type tones, e.g., greater than about 2 kHz, while active noise cancellation may be used for lower frequencies, such as about 35-190 Hz.

Figure 4:
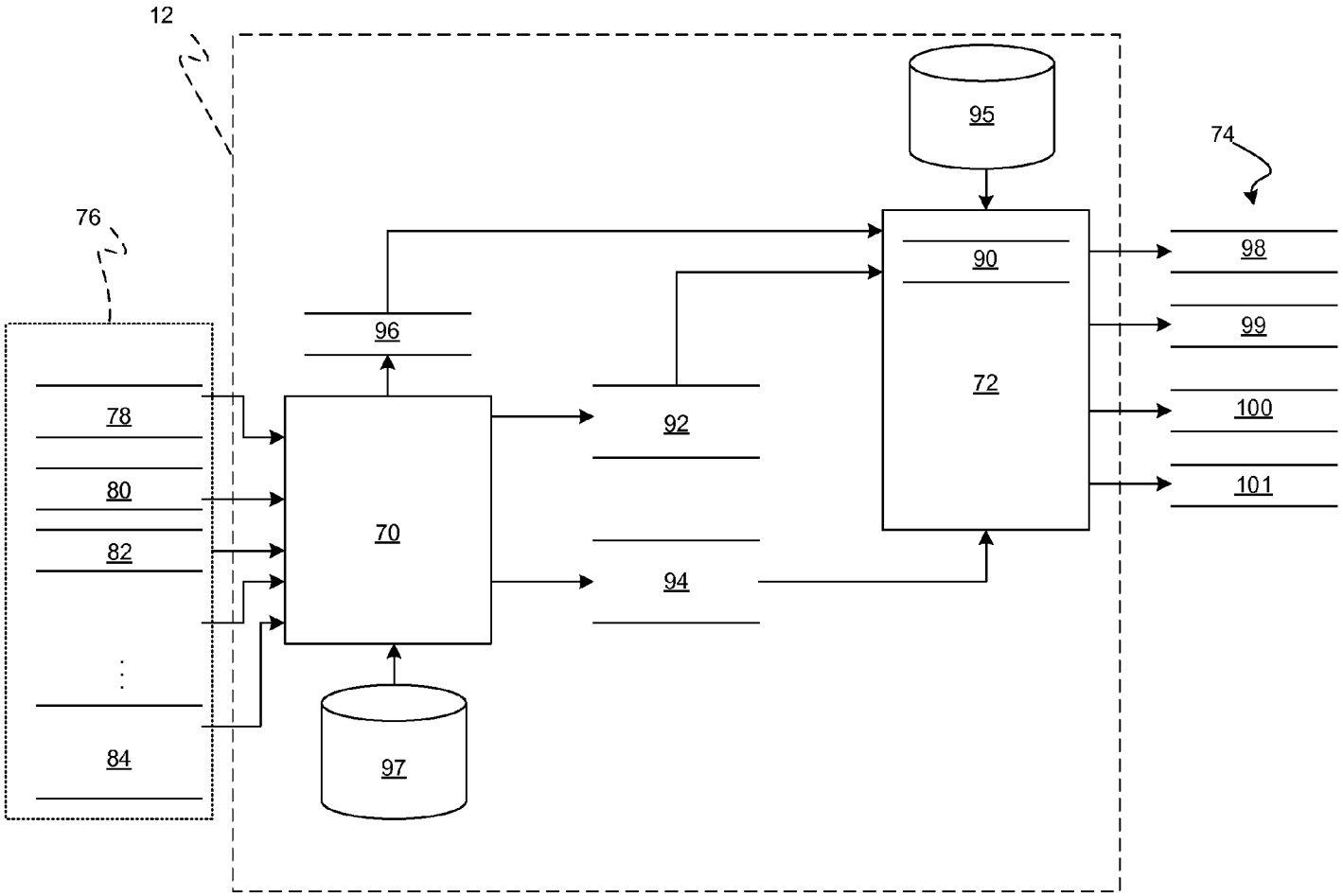
FIG. 4 is a dataflow diagram illustrating a vehicle noise masking system in accordance with an exemplary embodiment.

Referring now to FIG. 4, a dataflow diagram illustrates various embodiments of the vehicle noise masking system 12. As can be appreciated, various embodiments of vehicle noise masking systems 12 according to the present disclosure may include any number of modules. As can be appreciated, the modules shown in FIG. 4 may be combined and/or further partitioned to similarly perform vehicle noise masking. Inputs to the vehicle noise masking system 12 may be sensed directly from the vehicle 10 of FIG. 1, received from other modules within the vehicle 10 of FIG. 1, for example, via the vehicle communication network 66 of FIG. 1, and/or determined/modeled by other modules (not shown) of the vehicle noise masking system 12. In various embodiments, the vehicle noise masking system 12 includes a disturbance determination module 70 and a noise masking module 72 configured to generate an audio output 74.

The disturbance determination module 70 receives as input vehicle data 76. The vehicle data 76 can be received on the vehicle communication network 66 of FIG. 1 as a plurality of vehicle parameters and/or other input sources (not depicted). The vehicle data 76 can include, for example, but is not limited to, electric motor data 78 of the electric drive motors 46*a* and 46*b* of FIGS. 2 and 3, vehicle speed 80, engine data 82 of the engine 20 of FIGS. 2 and 3, transmission data 84 for the transmission 30 of FIGS. 2 and 3, or other signals indicative of vehicle conditions. The vehicle data 76 can also or alternatively include audio input from one or more microphones (not depicted). Electric motor data 78 may include speed, torque, and/or acceleration information associated with the electric drive motors 46*a* and 46*b* of FIGS. 2 and 3. The vehicle speed 80 may represent a speed of the wheels 24 of FIG. 1 or a drive shaft or axle speed. The engine data 82 can include engine activation/deactivation status, speed, torque, and/or acceleration of the engine 20 of FIGS. 2 and 3. The transmission data 84 can include a gear state, gear set torque, and/or gear mesh frequency of the transmission 30 of FIGS. 2 and 3.

Various signals can be provided directly in the vehicle data 76 or derived from the vehicle data 76. For example, gear set torque may be calculated as a linear sum of an engine torque, motor torque, and output torque. In a further example, gear mesh frequency can be derived as a linear sum of an engine speed, motor speed, and output speed. As another example, acceleration signals can be derived as a rate of change of speed/velocity signals. Examples of other vehicle signals can include a tachometer signal, relay states, a pump status, a cooling fan status, a speed of the generator 48 of FIGS. 2 and 3, and other signals indicative of changing vehicle conditions.

Based on the vehicle data 76 and a disturbance profile data store 97, the disturbance determination module 70 determines a tonal disturbance type 92. The tonal disturbance type 92 indicates a type of noise occurring to be masked. For example, when the powertrain 16 of FIG. 1 includes the hybrid system 44 of FIG. 2, the tonal disturbance type 92 can be, for example, electrical motor noise associated with deceleration of the vehicle 10, in conjunction with the engine 20 of FIGS. 2 and 3 being off (e.g., an engine speed of zero revolutions per minute). The activation/deactivation status of the engine 20 of FIGS. 2 and 3 can serve as an enable signal to determine when to perform vehicle noise masking, as noises may be more noticeable when the engine 20 of FIGS. 2 and 3 is off or running at a low speed. A fan speed range, electric motor speeds, relay switching frequencies, and other time varying signals that can produce a hardware resonance that may be tracked and characterized by the disturbance determination module 70.

Predetermined vehicle characteristic patterns based on one or more values in the disturbance profile data store 97 provide disturbance profile data for comparison and identification of the tonal disturbance type 92 in view of the vehicle data 76. For example, disturbance profile data may be defined based on one or more of: an engine speed range, an electric motor speed range, a vehicle speed range, an engine activation status, an engine torque, an electric motor torque, a gear set torque, a gear set mesh frequency, a fan speed range, a pump speed range, a relay status, a transient speed profile, an acceleration rate, a gear shift initiation, a gear shift duration, and a gear shift completion.

Upon identifying a tonal disturbance type 92, the disturbance determination module 70 can identify an associated tracking parameter 94 and a tone to mask 96. For example, if the tonal disturbance type 92 is based on electric drive motor speed as an electric drive motor type disturbance, the associated tracking parameter 94 can be an electric drive motor speed or a vehicle speed, and the tone to mask 96 can be defined as a particular frequency that is known to be an offending tone under the associated vehicle conditions.

The noise masking module 72 receives as input the tonal disturbance type 92, the associated tracking parameter 94, a noise masking data store 95, and/or the tone to mask 96. Based on the inputs 92, 94, 95, and 96, the noise masking module 72 applies a shaped band of sounds 90 to effectively blend the tone to mask 96. In various embodiments, tone information for noise masking is predetermined and stored in the noise masking data store 95 in a two or three dimensional table format based on the tonal disturbance type 92, the associated tracking parameter 94, and/or the tone to mask 96. The shaped band of sounds 90 can be determined in real time using a table lookup function in the noise masking data store 95. In various other embodiments, the shaped band of sounds 90 is estimated based on one or more tone generating and shaping functions in the noise masking module 72. The shaped band of sounds 90 can include particular tones, broadband noise (e.g., random white noise), or a combination thereof. In one embodiment, the shaped band of sounds 90 includes one or more harmonics of the tone to mask 96 thereby forming a chord to blend the tone to mask 96 with one or more similar sounds. Where there are multiple tones to mask 96, each tone to mask 96 may act as a fundamental frequency for adding one or more integer multiple harmonic waveforms to form multiple chords for noise masking.

In various embodiments, the noise masking module 72 can apply a shaped band of sounds 90 selected for the tone to mask 96 to generate the audio output 74 as one or more noise masking signals 98, 99, 100, 101. The noise masking signals 98-101 may represent front left, front right, rear left, and rear right audio signals of the audio output 74 to be combined with output of the infotainment system 60 to effectively hide the tone to mask 96 within additive noise. Although four noise masking signals 98-101 are depicted and described, it will be understood that any number noise masking signals can be generated in exemplary embodiments. The noise masking signals 98-101 can control selected speakers 64 of FIG. 1 in combination with other audio output. In various other embodiments, the noise masking signals 98-101 are communicated directly to selected speakers 64 of FIG. 1 for vehicle noise masking. For example, by projecting the noise masking signals 98-101 through selected speakers 64 of FIG. 1, the sounds can be blended across tonal disturbance transitions through the introduction of masking sounds and ramping of sounds. Blending of sounds can include at least partially overlapping multiple tones in time to smooth transitions between sounds. The timing of the noise masking signals 98-101 can be based on trends identified by the noise masking module 72. For example, the duration of the noise masking signals 98-101 can be longer than the time of an actual disturbance so that the disturbance is harder to perceive. The noise masking signals 98-101 may also be adjusted for background noise level.

Figure 5:
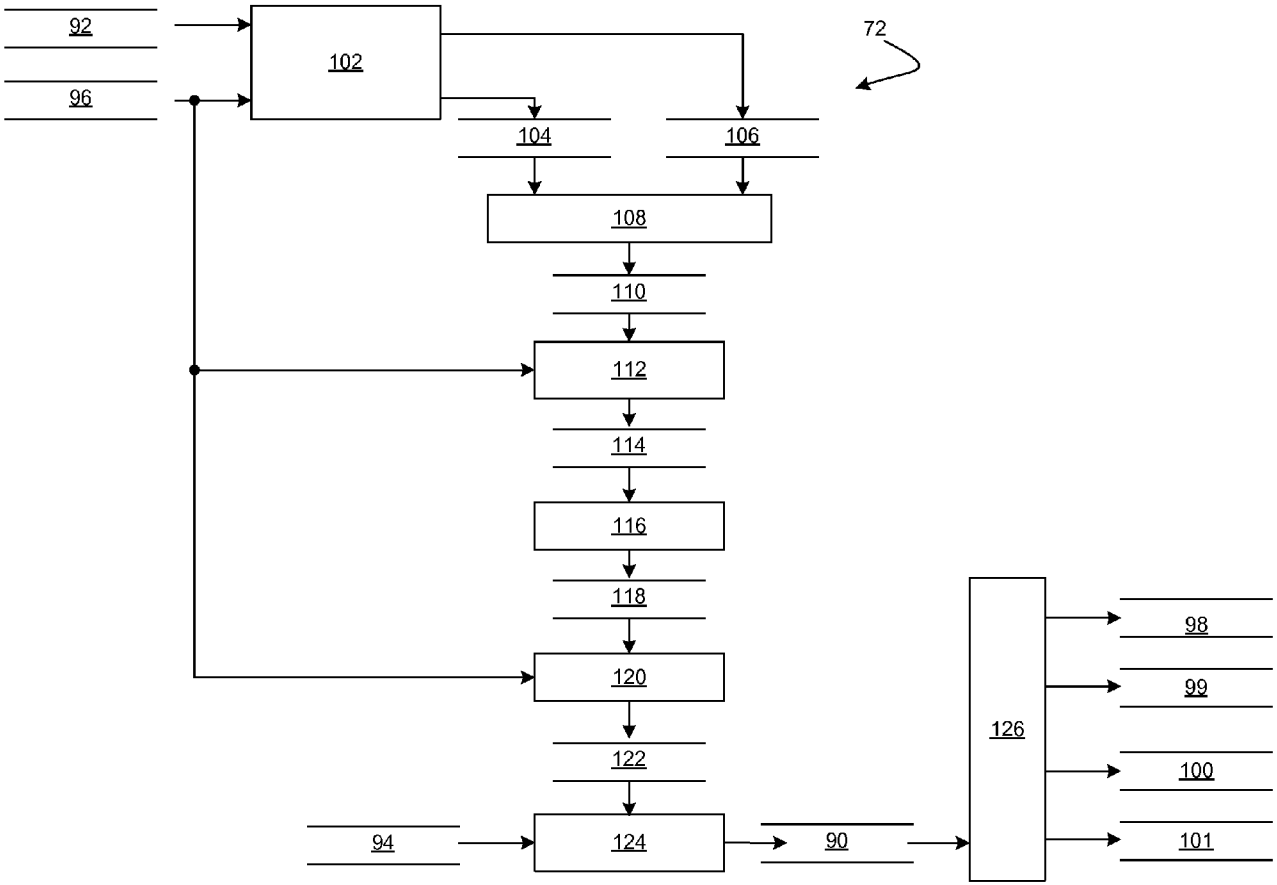
FIG. 5 is a dataflow diagram illustrating a noise masking module in accordance with an exemplary embodiment.

FIG. 5 is a dataflow diagram illustrating the noise masking module 72 of FIG. 4 in accordance with an exemplary embodiment. As an exemplary embodiment where the shaped band of sounds 90 is created for direct use or to populate lookup tables in the noise masking data store 95, the noise masking module 72 may include a number of signal processing functions. A limit selector 102 can use the tonal disturbance type 92 and the associated tracking parameter 94 to select a lower noise band limit 104 and an upper noise band limit 106 to frequency limit a noise band to add to the tone to mask 96. A noise band generator 108 generates noise that includes multiple tones between the lower noise band limit 104 and the upper noise band limit 106 to produce band limited noise 110. The band limited noise 110 is passed to a noise shaping block 112 that applies a shaping function based on the tone to mask 96. The shaping function may be a filter that places more energy near the tone to mask 96 to produce shaped band limited noise 114. The shaped band limited noise 114 may be passed through a low pass filter 116 to remove high frequency content, smooth transitions, and produce low pass filtered noise 118. The low pass filtered noise 118 is passed to a band stop filter 120 that is tuned to the tone to mask 96. The band stop filter 120 may be implemented as a combination of a low pass and high pass filter configured to drive energy content at the tone to mask 96 to a minimum as band stop filtered noise 122. After the band stop filter 120, a fading function 124 can be applied to the band stop filtered noise 122 based on the tracking parameter 94. The fading function 124 may produce a shaped band of sounds that fades in to slowly transition on, tracks to the tracking parameter 94 with a corresponding in-band gain, and fades out to slowly transition off, resulting in the shaped band of sounds 90. The shaped band of sounds 90 may be divided by a splitter 126 between the noise masking signals 98-101. Blending of partially overlapping multiple tones in time and/or fading may be applied to chords of harmonics as well.

The noise masking module 72 as depicted in FIG. 5 can be implemented in whole or in part within the vehicle noise masking system 12 of FIG. 4. For example, the generation of the shaped band of sounds 90 can be performed dynamically while the vehicle 10 of FIG. 1 is operable. Alternatively, the shaped band of sounds 90 can be developed offline or on a separate system (not depicted) and a lookup operation performed into the noise masking data store 95 of FIG. 4 to determine the shaped band of sounds 90 based on one or more of the tonal disturbance type 92, the tracking parameter 94, and the tone to mask 96. As a further alternative, one or more of the values 110, 114, 118, or 122 can be based on a lookup operation performed into the noise masking data store 95 of FIG. 4 based on previous calculations. Filtering and gain adjustments can be configured to accommodate interior audio transfer functions of the vehicle 10 of FIG. 1, background noise level, and particular frequency, amplitude, and phase relationships of noises of the vehicle 10 of FIG. 1.

Although the examples of FIGS. 4 and 5 are described in reference to detecting and masking a single tone to mask 96 associated with a particular tonal disturbance, it will be understood that multiple tonal disturbances can be monitored, tracked, and accommodated in parallel within the scope of exemplary embodiments. For example, there can be multiple instances of the noise masking module 72 operated in parallel with resulting noise masking signals 98-101 combined. Alternatively, the disturbance determination module 70 and the noise masking module 72 can process multiple tonal disturbances and tones to mask 96 in parallel, for instance, using vector processing.

Figure 6:
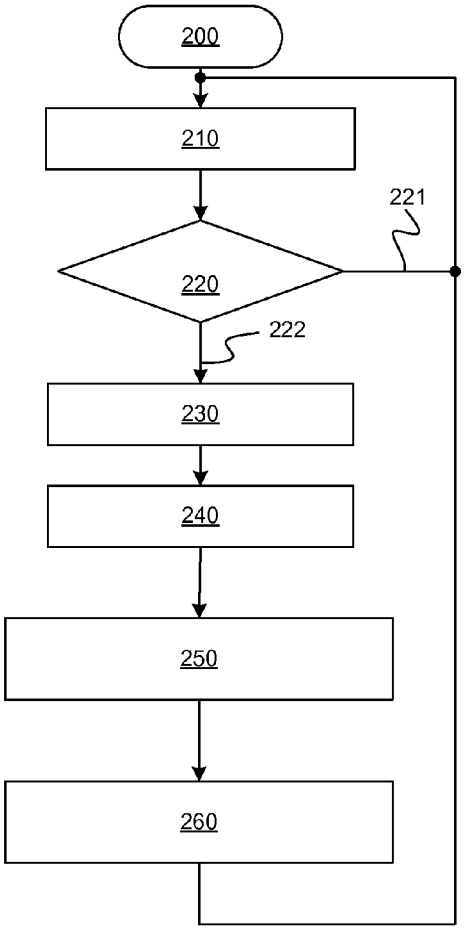
FIG. 6 is a flowchart illustrating a vehicle noise masking method in accordance with an exemplary embodiment.

Referring now to FIG. 6, and with continued reference to FIGS. 1-5, a flowchart illustrates vehicle noise masking methods that can be performed by the vehicle noise masking system 12 in accordance with the present disclosure. As can be appreciated in light of the disclosure, the order of operations within the method is not limited to the sequential execution as illustrated in FIG. 6, but may be performed in one or more varying orders as applicable and in accordance with the present disclosure. As can further be appreciated, one or more steps may be added or removed without altering the spirit of the method.

In various embodiments, the method of FIG. 6 can be scheduled to run based on predetermined events, and/or run continually during operation of the vehicle 10.

In one example, the method may begin at 200. The vehicle data 76 is monitored at 210 to identify a tonal disturbance type 92 at 220. If analysis of the vehicle data 76 against corresponding disturbance profile data store 97 indicates a tonal disturbance type 92 is not detected at 221, the method continues with monitoring the vehicle data at 210.

If, however, a tonal disturbance is detected at 222, the tonal disturbance type 92 is determined at 230. An associated tracking parameter 94 and tone to mask 96 may be determined at 240. A shaped band of sounds 90 is determined at 250 based on the tone to mask 96, where the shaped band of sounds 90 covers a range of frequencies around the tone to mask and may have a lower energy content at the tone to mask 96. The shaped band of sounds 90 is applied to an audio output 74 of the vehicle 10 at 260. The audio output 74 may be sent to the infotainment system 60 as one or more noise masking signals 98-101 to output on one or more speakers 64. The duration of outputting the shaped band of sounds 90 may be based on the tonal disturbance type 92 and/or the associated tracking parameter 94. The method of FIG. 6 continues monitoring vehicle data 76 at 210 for one or more tonal disturbances.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the application.

What is claimed is:

1. A method of masking noise associated with a vehicle, comprising:

performing on processing circuitry, monitoring vehicle data;

identifying a tonal disturbance type and a tone to mask associated with the tonal disturbance type based on the vehicle data;

determining a shaped band of sounds based on the tone to mask, the determining comprising:

selecting a lower noise band limit and an upper noise band limit;

generating multiple tones between the lower noise band limit and the upper noise band limit to produce band limited noise;

applying a shaping function to the band limited noise based on the tone to mask to produce shaped band limited noise; and applying a band stop filter to lower the energy content at the tone to mask; and applying the shaped band of sounds to an audio output of the vehicle.

2. The method of claim 1, further comprising:

comparing the vehicle data to a disturbance profile to identify the tonal disturbance type; and initiating application of the shaped band of sounds to the audio output based on identifying the tonal disturbance type.

3. The method of claim 2, wherein the disturbance profile is defined based on one or more of: an engine speed range, an electric motor speed range, a vehicle speed range, an engine activation status, an engine torque, an electric motor torque, a gear set torque, a gear set mesh frequency, a fan speed range, a pump speed range, a relay status, a transient speed profile, an acceleration rate, a gear shift initiation, a gear shift duration, and a gear shift completion.

4. The method of claim 1, further comprising:

determining a tracking parameter associated with the tonal disturbance type; and adjusting the shaped band of sounds based on the tracking parameter, wherein adjusting the shaped band of sounds further comprises establishing a fade in, a fade out, and an in-band gain for the shaped band of sounds, and blending sounds by at least partially overlapping multiple tones in time.

5. The method of claim 1, wherein the shaped band of sounds has lower energy content at the tone to mask.

6. The method of claim 1, further comprising:

identifying additional tonal disturbance types and additional tones to mask associated with the additional tonal disturbance types based on the vehicle data; and determining the shaped band of sounds based on the additional tones to mask, the shaped band of sounds covering a range of frequencies around the additional tones to mask.

7. The method of claim 1, wherein the shaped band of sounds comprises one or more harmonics of the tone to mask.

8. A system, comprising:

a disturbance determination module that monitors vehicle data and identifies a tonal disturbance type and a tone to mask associated with the tonal disturbance type based on the vehicle data; and a noise masking module that determines a shaped band of sounds to apply as an audio output based on the tone to mask, generates multiple tones between the lower noise band limit and the upper noise band limit to produce band limited noise, applies a shaping function to the band limited noise based on the tone to mask to produce shaped band limited noise, and applies a band stop filter to lower the energy content at the tone to mask.

9. The system of claim 8, wherein the disturbance determination module compares the vehicle data to a disturbance profile to identify the tonal disturbance type, and the noise masking module initiates application of the shaped band of sounds to the audio output based on identifying the tonal disturbance type.

10. The system of claim 9, wherein the disturbance profile is defined based on one or more of: an engine speed range, an electric motor speed range, a vehicle speed range, an engine activation status, an engine torque, an electric motor torque, a gear set torque, a gear set mesh frequency, a fan speed range, a pump speed range, a relay status, a transient speed profile, an acceleration rate, a gear shift initiation, a gear shift duration, and a gear shift completion.

11. The system of claim 8, wherein the disturbance determination module determines a tracking parameter associated with the tonal disturbance type, and the noise masking module adjusts the shaped band of sounds based on the tracking parameter, including establishing a fade in, a fade out, and an in-band gain for the shaped band of sounds, and blending sounds by at least partially overlapping multiple tones in time.

12. The system of claim 8, wherein the shaped band of sounds has lower energy content at the tone to mask.

13. The system of claim 8, wherein the disturbance determination module identifies additional tonal disturbance types and additional tones to mask associated with the additional tonal disturbance types based on the vehicle data, and the noise masking module determines the shaped band of sounds based on the additional tones to mask, the shaped band of sounds covering a range of frequencies around the additional tones to mask.

14. The system of claim 8, wherein the shaped band of sounds comprises one or more harmonics of the tone to mask.

15. A vehicle, comprising:

a powertrain;

a control module that selectively controls one or more components of the powertrain and generates vehicle data; and a vehicle noise masking system that monitors the vehicle data, identifies a tonal disturbance type and a tone to mask associated with the tonal disturbance type based on the vehicle data, and determines a shaped band of sounds to apply as an audio output of the vehicle based on the tone to mask by selection of a lower noise band limit and an upper noise band limit, generation of multiple tones between the lower noise band limit and the upper noise band limit to produce band limited noise, application of a shaping function to the band limited noise based on the tone to mask to produce shaped band limited noise, and application of a band stop filter to lower the energy content at the tone to mask.

16. The vehicle of claim 15, wherein the vehicle noise masking system compares the vehicle data to a disturbance profile to identify the tonal disturbance type, and initiates application of the shaped band of sounds to the audio output based on identifying the tonal disturbance type.

17. The vehicle of claim 16, wherein the disturbance profile is defined based on one or more of: an engine speed range, an electric motor speed range, a vehicle speed range, an engine activation status, an engine torque, an electric motor torque, a gear set torque, a gear set mesh frequency, a fan speed range, a pump speed range, a relay status, a transient speed profile, an acceleration rate, a gear shift initiation, a gear shift duration, and a gear shift completion.

18. The vehicle of claim 15, wherein the vehicle noise masking system determines a tracking parameter associated with the tonal disturbance type, and adjusts the shaped band of sounds based on the tracking parameter, including establishing a fade in, a fade out, and an in-band gain for the shaped band of sounds, and blending sounds by at least partially overlapping multiple tones in time.

19. The vehicle of claim 15, wherein the vehicle noise masking system identifies additional tonal disturbance types and additional tones to mask associated with the additional tonal disturbance types based on the vehicle data, and determines the shaped band of sounds based on the additional tones to mask, the shaped band of sounds covering a range of frequencies around the additional tones to mask.

20. The vehicle of claim 15, wherein the shaped band of sounds comprises one or more harmonics of the tone to mask.

* * * * *